United States Patent [19]

Matsuda

[11] 3,983,721

[45] Oct. 5, 1976

[54] SLIDE FASTENER TAPE

[75] Inventor: Yoshio Matsuda, Nyuzen, Japan

[73] Assignee: Yoshida Kogyo Kabushiki Kaisha, Japan

[22] Filed: Nov. 18, 1974

[21] Appl. No.: 524,928

[30] Foreign Application Priority Data

Nov. 19, 1973 Japan ..... 48-133472[U]

[52] U.S. Cl. ..... 66/195; 24/205.1 C

[51] Int. Cl.[2] ..... D04B 21/00

[58] Field of Search ..... 66/193, 194, 195; 24/206.1 BC, 205.16 C, 205.1 C; 138/384 B

[56] References Cited

UNITED STATES PATENTS

| | | | |
|---|---|---|---|
| 3,708,836 | 1/1973 | Frolich et al. | 24/205.1 C |
| 3,762,002 | 10/1973 | Frohlick | 66/195 |
| 3,820,202 | 6/1974 | Takamatsu | 24/205.13 C |
| 3,849,842 | 11/1974 | Yoshida | 24/205.16 C |
| 3,874,036 | 4/1975 | Yoshikawa | 24/205.1 C |

*Primary Examiner*—Ronald Feldbaum

*Attorney, Agent, or Firm*—Bucknam and Archer

[57] ABSTRACT

A warp-knitted tape for slide fasteners is provided with a web portion and a marginal edge portion extending longitudinally thereof and connected together integrally with a combination of different stitches. The marginal edge portion has two adjacent wales spaced one wale pitch apart to provide thread-free regions for unrestricted passage of sewing needles.

2 Claims, 2 Drawing Figures

SLIDE FASTENER TAPE

BACKGROUND OF THE INVENTION

This invention relates to a carrier tape for slide fastener and has particular reference to a warp-knitted tape for mounting thereon a row of interlocking fastener elements.

There are known various types of warp-knitted tapes for use in the field of slide fasteners or zippers. Warp-knitted tapes of the known type are basically constructed with longitudinally extending chain stitches which form a multiplicity of wales and transversely extending lapping threads laid in to connect the wales coursewise. However, due primarily to their structural characteristics, the knitted tapes are susceptible to both longitudinal and transverse stretch and hence are not suitable per se for use in holding rows of fastener elements stably in position.

Attempts have been made to hold such stretch to a minimum mostly by making the knitted structure as fine and compact as possible. However, this has in turn led to the drawback that when sewing the fastener elements to the tape, the sewing needle tends to slip out of the correct line of path on account of resistance of too finely knitted threads, resulting in misaligned row of fastener elements on the tape. Such misalignment is pronounced in the event the tape is deficient in thickness at its edge to which the fastener elements are to be secured.

SUMMARY OF THE INVENTION

With the above noted drawback of the prior art in view, it is an object of this invention to provide an improved warp-knitted carrier tape for slide fastener which is highly resistant to stretch and which is contrived to permit a sewing needle to follow a correct line of path along a longitudinal marginal edge of the tape thereby securing a row of fastener elements into properly aligned position on the tape.

Briefly stated, the knitted carrier tape according to the invention comprises a web portion and a marginal edge portion extending longitudinally thereof, said web portion comprising chain stitches which form longitudinally extending wales and tricot stitches interknitted therewith and inter-connecting said wales, said marginal edge portion consisting of a first or innermost wale, a second wale adjacent thereto and warp threads knitted in a direction to close the open laps of the respective first and second wales, said first and second wales being spaced apart by a distance substantially corresponding to one pitch of wale and being interconnected by said warp threads to provide thread-free regions.

The invention itself, together with the further objects and advantages thereof, will appear more clear from the following detailed description taken in connection with the accompanying drawings illustrating by way of example a preferred embodiment which the invention may assume in practice.

BRIEF DESCRIPTION OF THE ACCOMPANYING DRAWINGS

FIG. 1 diagrammatically illustrates the construction of a warp-knitted carrier tape according to the invention;

FIG. 2 illustrates a transverse cross-section of the same with a row of fastener elements mounted thereon.

DESCRIPTION OF THE PREFERRED EMBODIMENTS

Figure 1:
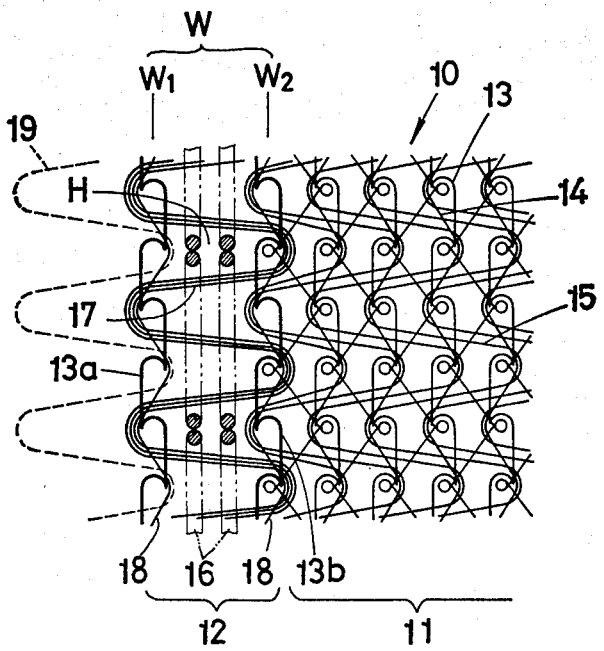

Referring now to FIG. 1, there is shown a carrier tape of warp-knitted structure for slide fasteners, which tape generally designated by the reference numeral 10 comprises a web portion 11 and a marginal edge portion 12 extending longitudinally thereof. The web portion 11 is basically constructed with chain stitches 13, which form longitudinally extending wales W, and tricot stitches 14 interknitted therewith. Laid into this foundation structure are transversely extending lapping threads 15 each laid over and across a plurality of wales W and arranged to warp around a location where chain stitch 13 and tricot stitch 14 are interknitted in each course.

Figure 2:
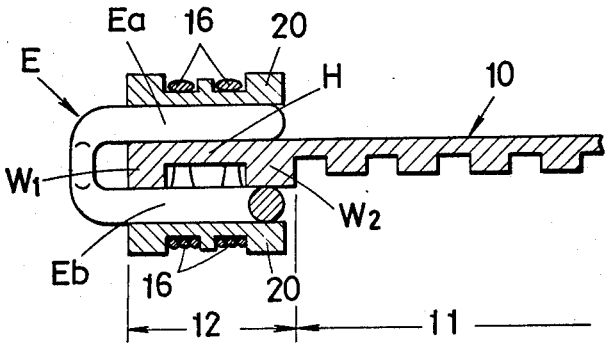

As illustrated in FIG. 2, the marginal edge portion 12 of the tape 10 to which the fastener elements (E) are to be attached is comprised of chain stitches 13*a* and 13*b* forming a first wale $W_1$ and a second wale $W_2$, respectively. The first wale $W_1$ located at an extremity or innermost of the tape 10 and the second wale $W_2$ lying adjacent thereto are spaced apart by a distance substantially corresponding to one pitch of wale so as to provide thread-free regions H. These thread-free or course regions H provide unrestricted passage for sewing needles (not shown) such that the needles can run straight along a correct line of path, without slippage, to produce stitchings 16 that secure the fastener elements into properly aligned position on the tape 10. The chain stitches 13*a* and 13*b* in the marginal edge portion 12 are preferably formed of bulk yarns of plastics material or textile yarns of large count such as spun yarns. The first wale $W_1$ and the second wale $W_2$ are interconnected by transverse lapping threads 17 comprised of threads thicker and stronger than lapping threads 15 in the web portion 11 or two or more of the latter threads bundled together. There are provided warp threads 18 which are arranged along the first and second wales $W_1$ and $W_2$, respectively, and each of the warp threads 18 is knitted in a direction to close the open laps of the respective wale.

It will be seen that the web portion 11 and the marginal edge portion 12 are connected together integrally with the combination of transverse lapping threads 17, chain stitches 13*b*, tricot stitches 14 and lapping threads 15, resulting in the formation of the second wale $W_2$ which is larger than the rest of wales.

Designated at 19 is a connecting thread adapted to connect a plurality of unit tapes widthwise that are produced in parallel, which connecting thread may be removed to separate the tapes to individual product lengths in a manner well known in the art.

Referring to FIG. 2, there is shown an example of the manner in which a row of fastener elements E is attached to the tape 10 provided in accordance with the invention. The fastener elements E shown to be of a meander form are mounted with their upper and lower legs E*a*, E*b* disposed astride or sandwiching the marginal edge portion 12 of the tape 10 and secured in position by stitchings 16 that run through a pair of braids 20 laid over the respective legs E*a*, E*b* of the fastener elements.

Having thus described the invention, it will be understood that various changes and modifications may be made in the specific form and construction herein ad-vanced, without departing from the scope of the appended claims.

What is claimed is:

1. A warp-knitted tape for slide fasteners which comprises a web portion and a marginal edge portion extending longitudinally thereof; said web portion having chain stitches which form longitudinally extending wales, tricot stitches interknitted with said chain stitches and interconnecting said wales and a first set of transversely extending lapping threads laid over and across said wales and arranged to wrap around respective locations where said chain stitches and tricot stitches are interknitted; said marginal edge portion having chain stitches forming a first longitudinally extending wale and a second longitudinally extending wale, warp threads laid in and along said first and second wales, and a second set of transversely extending lapping threads, said first and second wales being interconnected transversely by said second set of lapping threads exclusively and in spaced-apart relation to define between said first and second wales a longitudinally extending groove that accommodates passing stitches through the tape to secure same to a row of fastener elements.

2. A warp-knitted tape according to claim 1 wherein the transverse lapping threads of said second set are individually thicker and stronger than the individual transverse lapping threads of said first set.

* * * * *